US005641126A

United States Patent [19]

Nally et al.

[11] Patent Number: 5,641,126

[45] Date of Patent: Jun. 24, 1997

[54] FUEL INJECTION SYSTEMS WITH COMPACT FILTER MOUNTINGS

[75] Inventors: Debora E. Nally, Williamsburg; David P. Wieczorek, Newport News; Michael J. Frick, Yorktown, all of Va.

[73] Assignee: Siemens Automotive Corporation, Auburn Hills, Mich.

[21] Appl. No.: 444,495

[22] Filed: May 19, 1995

[51] Int. Cl.[6] ..... B05B 1/14

[52] U.S. Cl. ..... 239/575; 239/590.3

[58] Field of Search ..... 239/575, 590, 239/590.3, 585.1–585.5, DIG. 23, 900

[56] References Cited

U.S. PATENT DOCUMENTS

| | | | |
|---|---|---|---|
| 3,782,640 | 1/1974 | Kirschmann | 239/575 X |
| 5,046,472 | 9/1991 | Linder | 239/585.3 X |
| 5,080,069 | 1/1992 | Hudson | 239/575 X |
| 5,188,297 | 2/1993 | Asano | 239/585.1 X |
| 5,335,863 | 8/1994 | DeGrace | 239/575 |
| 5,356,079 | 10/1994 | Rahbar . | |

FOREIGN PATENT DOCUMENTS

| | | | |
|---|---|---|---|
| 91363 | 3/1992 | Japan | 239/575 |

*Primary Examiner*—Kevin Weldon
*Attorney, Agent, or Firm*—Russel C. Wells

[57] ABSTRACT

An engine fuel injection system includes a conventional fuel rail with a top feed fuel injector connected thereto. The overall length of the injector is able to be shortened by the application of compact fuel inlet filter mountings in which a well (deep cup) shaped filter element is positioned to overlap one or both of (1) an adjusting tube within the injector body and (2) a space between the end of the injector fuel inlet tube and the interior of the associated fuel rail. The filter may be fixed within the injector to the adjusting tube or the inlet tube or may be fixed externally of the injector to the fuel rail. Various exemplary embodiments are shown and described.

9 Claims, 2 Drawing Sheets

FUEL INJECTION SYSTEMS WITH COMPACT FILTER MOUNTINGS

FIELD OF THE INVENTION

This invention relates to engine fuel injectors and fuel injection systems. In particular, it relates to compact filter mounting arrangements for top feed engine fuel injectors and their associated fuel systems.

BACKGROUND OF THE INVENTION

It is known in the art relating to top feed engine fuel injectors to provide a well or cup shaped filter element retained within an inlet tube between its entrance end and the end of an associated adjusting tube. One prior conventional form of filter mounting consists of a well (or deep cup) shaped screen element connected at its open end to a brass ring that is pressed into the open end of the injector inlet tube. The screen portion of the filter element is spaced from the inner end of the associated adjusting tube. Fuel flows into the open end of the cup or well shaped element and out through the sides and bottom thereof into the hollow adjusting tube. Other forms of prior filter arrangements are shown in U.S. Pat. Nos. 5,335,863 issued Aug. 9, 1994 and 5,356,079 issued Oct. 18, 1994, both to the assignee of the present invention.

Another arrangement is shown in FIG. 1 of the drawings where there is illustrated for reference a prior art engine fuel injection system generally indicated by numeral 10. Injection system 10 includes a fuel rail 12 defining a passage for the delivery of fuel from a fuel source not shown. At spaced locations along the fuel rail there are provided a plurality of fuel rail cups 14, only one of which is shown. Each cup 14 includes a base 16 secured to the fuel rail and having an inturned edge defining a central port 18 through which fuel may flow from the interior fuel rail to the cup. The cup 14 further includes a cylindrical flange 20 depending from the base and forming with the base a recess open through the port 18 to the fuel rail.

A conventional top feed fuel injector generally indicated by numeral 22 includes a fuel inlet tube 24 having an entrance end 26 that is received within the cup 14 spaced axially from the port 18. An upper O-ring seal 28 retained adjacent the end of the inlet tube 24 engages the flange 20 of the cup to seal the connection against fuel leakage. A clip 30 secured to the injector housing 32 has a slot that engages an outturned end of the flange 20 to retain the injector in place in the cup 14.

Injector 22 includes a body 34 having a central axis 36 and including the inlet tube 24 and housing 32 centered on the axis 36. An adjusting tube 38 is telescopingly received within the inlet tube and engages at an inner end a spring 40 which in turn engages an armature 42 reciprocally movable within the body 34. The armature carries a valve needle 44 that extends through a needle guide 46 into engagement with conical surfaces of a valve seat 48 retained within the lower end of a valve body 50.

A magnetic coil 52 mounted in the injector body 34 surrounding the inlet tube 24 is positioned to attract the armature 42 when energized, moving the armature slightly against the bias of spring 40 and unseating the valve needle 44 from the seat 48. This allows fuel to flow along a fuel path from the interior of the fuel rail 12 through the port 18 into the entrance end of the fuel inlet tube 24. The fuel passes on through the adjusting tube 38 and spring 40 to an opening 54 in the armature 42 that allows the fuel to flow around the valve needle 44. It then is directed through openings 56 in the needle guide 46, past the end of the valve needle 44 and through an orifice 58 in the valve seat. The fuel then moves through an opening 60 in a backup washer 62 and out through the nozzle end of the injector into an associated cylinder head or inlet manifold not shown. An electrical connector 64 conducts electric current for energizing the magnetic coil 52 when desired.

In the illustrated prior art embodiment, the interior of the inlet tube 24 adjacent the entrance end is enlarged to receive yet another form of inlet fuel filter generally indicated by numeral 66. Filter 66 has a closed upper end 68 having a tubular screen mesh portion 70 below with an open lower end mounted on a filter connector 72. The filter connector has latching fingers 74 engaging a groove 76 near the inlet end of the adjusting tube 38 to retain the filter 66 on the inlet end of the adjusting tube and recessed within the end of inlet tube 24. The screen mesh portion 70 of the filter separates out particulates in the fuel entering the inlet tube to prevent their continued passage through the injector and into the engine in known manner.

With the exception of the embodiment of FIG. 2 of U.S. Pat. No. 5,356,079, the prior filter arrangements referred to all utilize a well or cup shaped filter element retained within the inlet tube between its entrance end and the end of the associated adjusting tube. These arrangements require space for the length of the filter element which adds to the required length of the inlet tube and therefore the overall length of the injector in the fuel injector system.

SUMMARY OF THE INVENTION

The present invention provides compact filter embodiments and mountings in combination with a top feed fuel injector and/or injection system which permit reducing the overall length of the injector between the end O-ring seals and thereby allow more compact engine installations of the associated fuel injection system.

These and other features and advantages of the invention will be more fully understood from the following description of certain exemplary embodiments of the invention taken together with the accompanying drawings.

DETAILED DESCRIPTION OF THE INVENTION

Referring now to FIGS. 2–6 of the drawings in detail, there are shown various illustrative embodiments of fuel filters and mountings according to the present invention. In the various figures, 100–500 series numerals are used in reference to the five embodiments. Elements similar to those enumerated in FIG. 1 are indicated by like numerals preceded by the indicated series numeral.

Figures 1, 2:
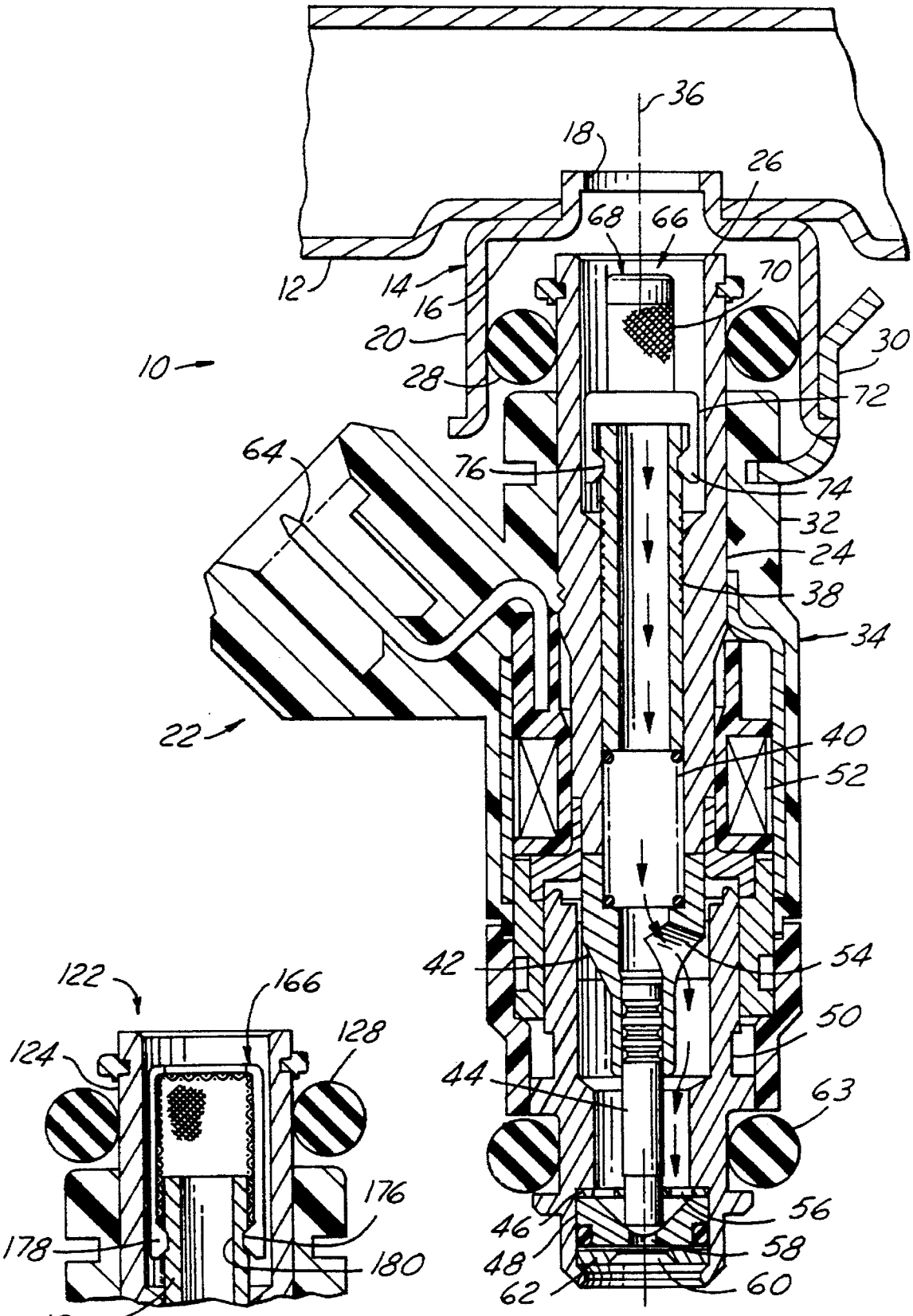
FIG. 1 (PRIOR ART)
FIG. 1 (described above) is a longitudinal cross-sectional view of a prior engine fuel injector mounted in a fuel injection system.
FIG. 2 is a longitudinal cross-sectional view showing the upper portion a first embodiment of fuel injector with a filter and its mounting according to the invention.

In FIG. 2 there is shown the upper end of a first embodiment of injector 122 formed according to the invention. The lower portions of injector 122 which are not shown may be identical to those of the prior art injector 22 previously described. Injector 122 differs in the provision of an inlet fuel filter 166 having a screen mesh body defining circumferential and outer end filtering surfaces. The outer end may be imperforate if desired to prevent fluid flow therethrough. As compared to the previously described embodiment, the mesh portion of the filter 166 is enlarged in diameter so that it is substantially larger than the adjusting tube 138 while remaining smaller than the interior of the inlet tube 124. At its inner open end, filter 166 has a resilient ring 178 with an inwardly protruding rib 180 that engages a groove 176 in the adjusting tube to sealingly retain the filter thereon.

The filter 166 is mounted on the adjusting tube 138 with about half its length, or a substantial portion, overlapping the inlet end of the adjusting tube. Fuel flow into the filter may pass through its outer end, if perforate, as well as through the cylindrical filter wall within the inlet tube. Fuel which passes through the filter wall into the space between it and the inlet end of the adjusting tube is able to flow backwards to reach the open inlet end for passage through the adjusting tube. Because of this filter overlap, the inlet tube 22 can be made shorter without requiring the outer end of the filter to extend beyond the inlet tube. In this way the overall length of the injector between the O-rings 128 and 63, (shown in FIG. 1) is reduced by the amount of filter overlap with the end of the adjusting tube 138.

Figure 3:
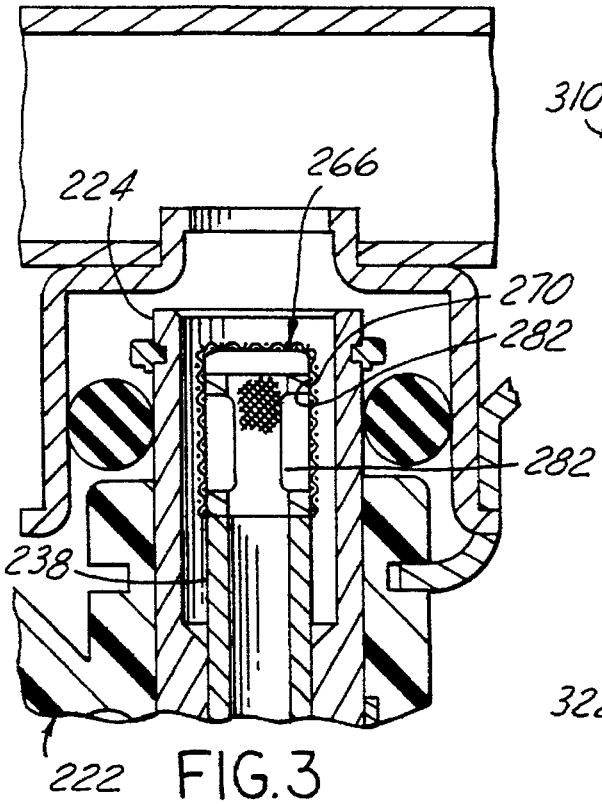
FIG. 3 is a view similar to FIG. 2 showing an alternative embodiment of the invention.

FIG. 3 shows another arrangement of injector 222 wherein the inlet fuel filter 266 comprises a screen mesh member mounted to and around the inlet end of the adjusting tube 238. Tube 238 is provided with a plurality of radial inlet openings 282 adjacent the inlet end of the adjusting tube through which fuel passes from the interior of the inlet tube 224 to the interior of the adjusting tube 238. In this embodiment, the entire length of the filter element 266 overlaps the inlet end of the adjusting tube, further reducing the allowable overall length of the injector which may be obtained by shortening the length of the inlet tube 224 accordingly.

Figure 4:
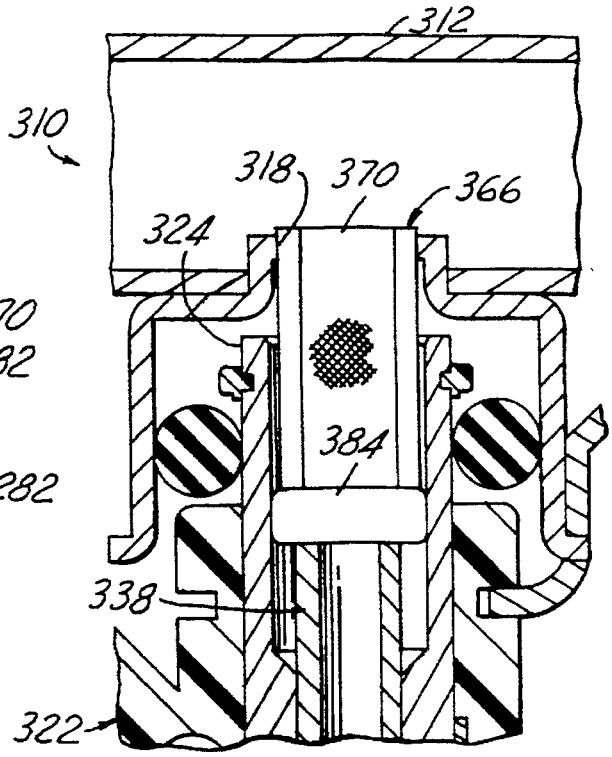
FIG. 4 is a longitudinal cross-sectional view showing another embodiment of fuel filter mounting with associated portions of an injector connected with a fuel rail.

FIG. 4 of the drawings illustrates yet another alternative embodiment of fuel system 310 including an injector 322 in which a prior conventional filter 366 has an open end connected with a brass ring 384. The filter has a mesh body 370 which may be supported by a ribbed plastic frame not shown in detail. The position of the filter is inverted from conventional arrangements so that the brass ring is pressed into the inlet tube 324 and engages the inlet end of the adjusting tube 338 and the mesh body 370 extends outwardly into the space beyond the end of the inlet tube and into the port 318. Thus, the overall length of the injector is shortened by allowing the filter element to extend outside the end of the inlet tube and into the port of the associated fuel rail 312.

Figure 5:
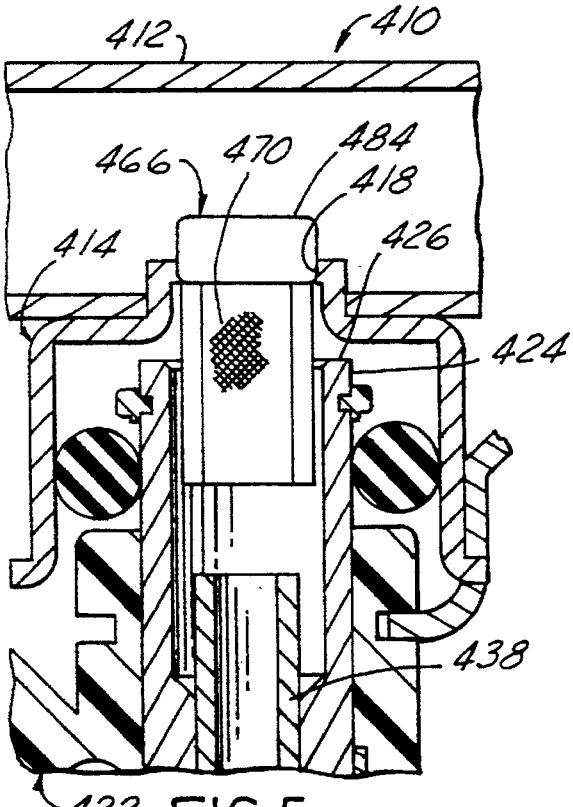
FIG. 5 is a view similar to FIG. 4 but showing yet another embodiment of the invention.

In FIG. 5, a fuel system 410 is shown which differs from that of FIG. 4 in that the fuel filter 466 is not mounted in the injector 422 but instead is supported by the brass ring 484 which is pressed into the port 418 of cup 414. The screen mesh portion 470 of the filter extends outward from the fuel rail 412 through the space between the port 418 and the entrance end 426 of the inlet tube 424 into the interior of the inlet tube. In this manner the space between the internal end of the filter screen portion 470 and the end of the adjusting tube 438 is lengthened so that the associated portion of the filter body in the inlet tube may be shortened accordingly to reduce the length of the injector.

Figure 6:
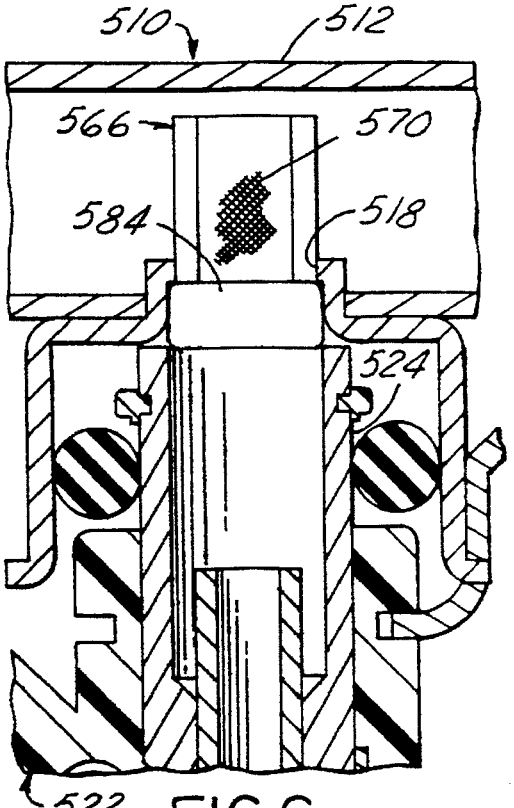
FIG. 6 is a view similar to FIGS. 4 and 5 showing still another embodiment of the invention.

Referring now to FIG. 6, yet another embodiment of fuel system 510 is illustrated in which the filter 566 is separated completely from the injector by mounting the brass ring 584 in the port 518 with the screen mesh portion 570 of the filter extending internally of the fuel rail 512. In this way the filter body does not extend at all within the injector 522 and poses no impediment to shortening the inlet tube 524 of the injector as far as can be accomplished, other considerations being taken into account. If desired, the embodiment of FIG. 6 could be modified by locating the filter in an intermediate position with the brass ring 584 closer to the inlet tube 524 or mounted therein and the mesh screen portion 570 of the filter extending through the port 518 and into the fuel rail 512.

Each of the exemplary embodiments described in FIGS. 2–6 provides a filter construction and mounting in which at least part of the filter length longitudinally overlaps either the injector adjusting tube or the space between the inlet tube and the fuel rail interior or both. In this way, the length of the inlet tube beyond the end of the adjusting tube may be shortened to reduce the overall length of the injector. In the case of an injector operating without an adjusting tube, the length may still be shortened by extending the filter into the inlet space between the inlet tube and the interior of the fuel rail as described above.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A fuel injector comprising a body having at one axial end a fuel inlet tube including an entrance through which fuel is introduced into a fuel passage that extends through said body to a nozzle at an opposite axial end of said body, an adjusting tube telescopically connected at its inlet end with said inlet tube such that fuel conducted from said entrance to said fuel passage passes through said adjusting tube, electrically controlled valve mechanism for controlling fuel flow through said fuel passage, said mechanism including an armature including a valve member biased toward closing against a seat by a spring disposed between the armature and an axially inner end of the adjusting tube and openable by electric actuation of the armature, and a filter disposed adjacent said entrance of the inlet tube for filtering particulate matter from fuel passing through the fuel injector, said injector characterized in that said filter has an inner diameter sufficiently larger than the mating outer diameter of the inlet tube and is mounted on the inlet end of and axially overlaps said adjusting tube so as to shorten the overall length of the injector to allow fuel flow from an overlapped portion of the filter to the inlet end of the adjusting tube.

2. A fuel injector as in claim 1 characterized in that the filter has an open inner end with an internal rib that engages a groove on the adjusting tube to sealingly retain the filter on the adjusting tube.

3. A fuel injection system including a fuel rail having a delivery port for delivery of fuel from the fuel rail, a connecting cup mounted on said rail externally surrounding said port, said cup including a base secured to said rail and a cylindrical flange depending from the base and forming therewith a cup-like recess open through the base to said port, a top feed fuel injector having a body with a first axial end sealingly received in said cup, said injector body having at said first axial end a fuel inlet tube including an entrance end spaced from said fuel rail delivery port and through which fuel is introduced into a fuel passage that extends through said body to a nozzle at an opposite axial end of said body, the path of fuel delivery into said fuel passage defining an inlet space extending from said fuel rail through said delivery port into said entrance end of the inlet tube; an adjusting tube having an inlet end in fluid communication with said inlet tube, said adjusting tube telescopically connected with said inlet tube such that fuel conducted to said fuel passage passes through said adjusting tube, electrically controlled valve mechanism for controlling fuel flow through said fuel passage, said mechanism having an armature including a valve member biased toward closing against a seat by a spring disposed between the armature and an axially inner end of the adjusting tube and openable by electric actuation of the armature, and a filter disposed in the path of fuel flow from the fuel rail to said fuel passage for filtering particulate matter from fuel passing through the fuel injector, said injection system being characterized in that said filter is mounted on said inlet end of said adjusting tube overlapping at least a portion thereof, the filter having an inner diameter sufficiently larger than the mating outer diameter of the inlet tube to allow fuel flow from the overlapped portion of the filter to said inlet end of the adjusting tube.

4. A fuel injection system as in claim 3 characterized in that said filter extends into said inlet space outward of said inlet tube.

5. A fuel injection system as in claim 3 characterized in that said filter is mounted to said adjusting tube and extends into said inlet space.

6. A fuel injection system as in claim 5 characterized in that said filter extends into said delivery port.

7. A fuel injection system including a fuel rail having a delivery port for delivery of fuel from the fuel rail, a connecting cup mounted on said rail externally surrounding said port, said cup including a base secured to said rail and a cylindrical flange depending from the base and forming therewith a cup-like recess open through the base to said port, a top feed fuel injector having a body with a first axial end sealingly received in said cup, said injector body having at said first axial end a tubular fuel inlet tube with an entrance end spaced from said fuel rail delivery port and through which fuel is introduced into a fuel passage that extends through said body to a nozzle at an opposite axial end of said body, the path of fuel delivery into said fuel passage defining an inlet space extending from said fuel rail through said delivery port into said entrance end of the tubular inlet tube, electrically controlled valve mechanism for controlling fuel flow through said fuel passage, said mechanism having an armature including a valve member biased toward closing against a seat by a spring and openable by electric actuation of the armature, and a filter disposed in the path of fuel flow from the fuel rail to said fuel passage for filtering particulate matter from fuel passing through the fuel injector, said injection system being characterized in that said filter is mounted so as to at least partially longitudinally overlap said inlet space and extends into said inlet space outward of said inlet tube.

8. A fuel injection system as in claim 7 characterized in that said filter is mounted to said inlet tube and extends into said inlet space.

9. A fuel injection system as in claim 8 characterized in that said filter extends into said delivery port.

* * * * *